United States Patent [19]

Sweeney

[11] 4,155,719

[45] May 22, 1979

[54] LOW POUR RESIDUAL FUEL COMPOSITIONS

[75] Inventor: William M. Sweeney, Wappingers Falls, N.Y.

[73] Assignee: Texaco Inc., White Plains, N.Y.

[21] Appl. No.: 854,302

[22] Filed: Nov. 23, 1977

[51] Int. Cl.[2] ..... C10L 1/18

[52] U.S. Cl. ..... 44/62; 44/70

[58] Field of Search ..... 44/62, 70; 526/320; 137/13

[56] References Cited

U.S. PATENT DOCUMENTS 3,467,597 9/1969 Tunkel et al. ..... 44/62

*Primary Examiner*—Patrick Garvin
*Assistant Examiner*—Y. Harris-Smith
*Attorney, Agent, or Firm*—Carl G. Ries; Thomas H. Whaley; Walter D. Hunter

[57] ABSTRACT

Low pour fuel oil compositions are prepared by incorporating in a residual fuel a small amount of an oil-soluble terpolymer such as (1) a vinyl acetate-ethylene-methacrylic or acrylic acid ester terpolymer of (2) vinyl acetate-ethylene-oxyalkylated acrylic acid terpolymer.

7 Claims, No Drawings

LOW POUR RESIDUAL FUEL COMPOSITIONS

BACKGROUND OF THE INVENTION

1. Field of the Invention

This invention is concerned with improving the flow properties and pour point characteristics of residual fuels. More particularly, this invention is concerned with fuel compositions comprising a residual fuel and an effective pour depressant amount of an oil-soluble terpolymer.

2. Description of the Prior Art

As is well known, residual fuel oils contain quantities of wax and asphaltic compounds which render them viscous and interfere with practical use of such oils. In particular, serious problems are encountered in pumping residual fuel oils to a burner and in making them flow at low temperatures. Other factors to be reckoned with are that these oils behave as non-Newtonian liquids at low temperatures; exhibit variable solidifying temperatures and peculiar hysteresis phenomena, all of which make for difficulties in equipment design.

One approach in making these oils easier to handle has been to subject them to fairly lengthy dewaxing procedures.

Another approach which has been used to bring the viscosity of residual fuel oils to suitable levels has been to dilute or "cut" them with a major amount of lighter distillate oils but this is an expensive procedure because of the considerably higher cost of the distillate oils relative to the residual oils.

A number of additives have been suggested and tried with success in lubricating oils and in so-called middle distillates in order to tie in the wax therein and improve flow at low temperatures. Such additives consist either of compounds formed by alkylating benzene or naphthalene derivatives or of copolymers of ethylene-vinyl fatty acid ester of a molecular weight up to 3000 and containing from 15 to 25% by weight of the vinyl saturated aliphatic monocarboxylic acid ester. These additives are not, however, effective in depressing the pour point of residual fuel oils.

It is therefore the main object of the present invention to improve the pour point characteristics of residual oils without using elaborate dewaxing procedures.

An equally important object of this invention is to provide heating oils and fuel oils having improved pour point characteristics by incorporating therein a minor amount of certain terpolymer pour depressants.

BRIEF DESCRIPTION OF THE INVENTION

The low pour fuel oil compositions of this invention comprise a residual fuel oil, which is preferably a waxy fuel oil, together with an effective pour depressant amount of an oil-soluble terpolymer such as an vinyl acetate-ethylene-methacrylate or acrylic ester terpolymer or a vinyl acetate-ethylene-ethoxylated or propoxylated acrylic acid terpolymer.

DETAILED DESCRIPTION OF THE INVENTION

Oil-soluble terpolymers useful in preparing the low pour compositions of this invention are of two types. The first of these includes terpolymers comprising recurring units of:

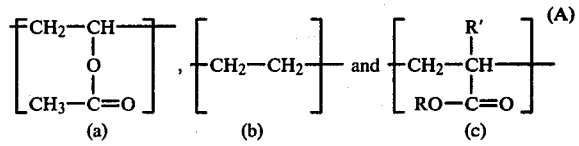

(A)

wherein R is straight chain or normal alkyl having about 10 to about 26 carbon atoms and mixtures thereof and R′ is selected from the group consisting of hydrogen and $-CH_3$.

In preparing the methacrylic or acrylic esters employed in this invention in terpolymer A, straight chain or normal saturated monohydric aliphatic alcohols having from about 10 to about 26 carbon atoms are employed. Examples of such alcohols include decyl, dodecyl, hexadecyl, heptadecyl, etc. If desired, mixtures of these alcohols may be utilized. Such long chain normal alcohols are available commercially although generally the commercial products are mixtures of the long chain materials and frequently a small amount of branched long chain alcohols and other impurities are present in the commercially available materials. A particularly useful group of commercial alcohols are the straight chain saturated monohydric aliphatic alcohols sold under the trade name of "Alfol" alcohols which are manufactured by The Continental Oil Company, New York, N.Y.

The second type of polymer suitable for use in the fuel compositions of this invention includes terpolymers comprising recurring units of:

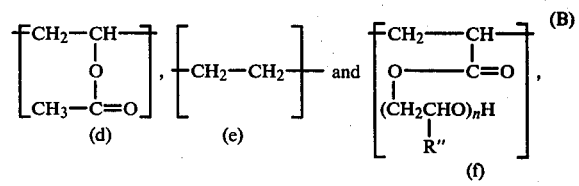

(B)

wherein R″ is selected from the group consisting of $-CH_3$ and hydrogen and n is an integer of from 1 to about 5 and preferably 1 to 2. The number average molecular weights of the terpolymers A and B utilized in this invention will range from about 5000 to about 85,000 or more and preferably will be from about 15,000 to about 50,000.

In terpolymer A above the weight percent of the a units (i.e., ethylene vinyl acetate units) is about 20 to about 45; the weight percent of b units (i.e., ethylene units) is about 50 to about 79 with the c units (i.e., methacrylate or acrylic ester units) being the balance. Likewise in terpolymer B above the weight percent of d units (i.e., vinyl acetate units) is about 20 to about 45; the weight percent of e units (i.e., ethylene units) is about 50 to 79 with the f units (i.e., ethoxylated or propoxylated acrylic acid units) being the balance.

Preparation of terpolymer types A and B above is conducted using processes well known in the art. For example, in preparing a Type A terpolymer a mixture of the required methacrylic ester and vinyl acetate is added to autoclave containing as a solvent a quantity of benzene, toluene, xylene, etc. following which the autoclave is purged with an inert gas such as nitrogen, argon, etc. and then with ethylene to a pressure of about 700 to about 1200 psig. Next a free radical type catalyst such as di-tert, butyl peroxide in, for example, benzene is pressurized into the autoclave over a period of from about 1 to about 5 hours or more during which time the temperature and pressure are usually maintained constant. Finally, the terpolymer product is recovered by stripping from the reaction mixture unreacted materials. Terpolymers of Type B are prepared in the same manner as the Type A polymers. The oxyalkylated acrylic acid used in preparing terpolymer B compounds are prepared by conventional methods in which ethylene oxide or propylene oxide is reacted with acrylic acid in a suitable solvent at a temperature of about 100° C. in an autoclave in the presence of a basic catalyst.

The amount of the terpolymer pour depressant incorporated into the fuel compositions of this invention may be varied over a wide range. Generally the amount of the terpolymer in the residual fuel oil composition will vary from about 0.01 to about 0.50 weight percent and preferably between about 0.02 to about 0.25 weight percent.

The required amount of terpolymer A or B may be added with mixing directly to the residual fuel which may be heated, if desired. Preferably, the terpolymer is added to the residual fuel in solution form dissolved in a hydrocarbon such as benzene, toluene, xylene, kerosene, etc., at a temperature of about 70° to about 200° C. with mixing. Generally, in the hydrocarbon solution the concentration of terpolymer A or B will be from about 0.5 to about 10 or more weight percent.

Although the fuel oil compositions of this invention may be prepared using any residual fuel oil the terpolymer pour depressants as previously described are particularly effective with high pour, waxy residual fuels.

In preparing the fuel oil compositions of this invention, high pour, waxy residual fuel oils which are particularly useful include fuel oils having an API gravity of about 20.0 to about 26.0; a sulfur content of between about 0.40 wt. percent and about 0.96 wt. percent; a Furol viscosity at 122° F. of about 60 to about 460; a pour point between about 80° and about 120° F.; a flash point of between about 300° and 450° F., with a wax content of between about 10 and 20 percent.

The physical properties of 650° F. Amna residual fuel which may be utilized in preparing the fuel compositions of this invention are as follows:

| | |
|---|---|
| API°, at 60° F. | 25.0 |
| Pour Point, °F. | +105 |
| Sulfur, Wt. % | 0.25 |
| Wax Content, Wt. % | 15.4 |
| Visc. at 210° F., cs | 26.18 |

The following example illustrates one embodiment of this invention and is to be considered not limitative.

EXAMPLE I

A mixture of 220 g. of vinyl acetate, 22 g. of the methacrylic ester of Alfol 1216 (a mixture of normal alcohols ranging from $C_{12}$ to $C_{16}$) is metered into an autoclave containing 840 cc. benzene that was purged with $N_2$, then with ethylene. The mixture is heated to 150° C. and pressurized with ethylene to 3000 psig. Twenty-two g. of di-tert butyl peroxide in 66 g. of benzene is also metered in over a period of 2 hours. The temperature and pressure are kept constant over this time. The terpolymer when stripped of unused reactants contains 28 weight percent vinyl acetate, 3 weight percent Alfol 1216 methacrylate and the balance ethylene.

A residual fuel oil composition is prepared by adding a sufficient amount of the above prepared terpolymer to Amna 650° F. residual fuel so that the concentration of the additive was 0.1 weight percent. The pour point of this composition was determined by the method of ASTM D-97 and found to be substantially below that of the Amna residual fuel alone.

EXAMPLE II

A type B terpolymer (Terpolymer I) consisting of about 31 weight percent of vinyl acetate, about 58 weight percent ethylene and with the balance being units of the formula:

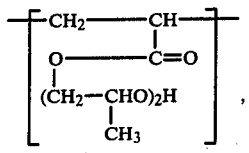

is prepared in the manner previously described. The resulting viscous random terpolymer is dissolved in benzene with mixing at a temperature of 100° C. to form a 10 weight percent solution.

A residual fuel composition is prepared by adding with mixing at a temperature of 125° C. a sufficient amount of the above-prepared solution of Terpolymer I to Amna 650° F. residual fuel so that the concentration of the additive was 0.10 weight percent. The pour point of this fuel oil composition is determined by the method of ASTM D-97 and found to be substantially below that of the Amna 650° F. residual fuel alone.

What is claimed is:

1. A residual fuel oil composition having improved pour point characteristics comprising a residual fuel oil and an effective pour depressant amount of an oil-soluble terpolymer comprising recurring units of:

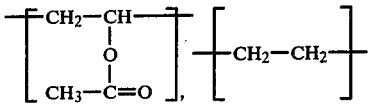

and

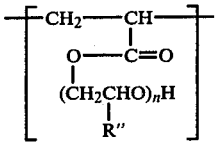

wherein R″ is selected from the group consisting of $-CH_3$ and hydrogen and n is an integer of from 1 to 5.

2. The composition of claim 1 wherein the said terpolymer comprises about 31 weight percent vinyl acetate, about 11 weight percent units of the formula

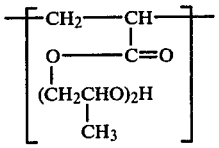

and with the balance being ethylene.

3. The composition of claim 1 wherein the amount of the said terpolymer employed is about 0.01 to about 0.50 weight percent.

4. The composition of claim 1 wherein the number average molecular weights of the said terpolymers will range from about 5000 to about 85,000.

5. The composition of claim 1 wherein the number average molecular weights of the said terpolymers will range from about 15,000 to about 50,000.

6. A solution of an oil-soluble terpolymer comprising recurring units of:

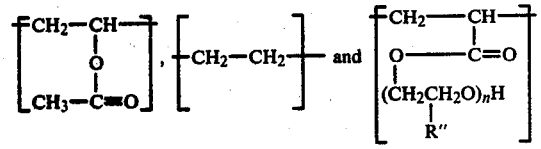

wherein R″ is selected from the group consisting of —$CH_3$ and hydrogen and n is an integer of from 1 to 5 in a hydrocarbon selected from the group consisting of benzene, toluene and xylene.

7. The solution of claim 6 wherein the concentration of the said terpolymer is about 0.5 to about 10 weight percent.

* * * * *